US010850295B2

(12) United States Patent
Wildt et al.

(10) Patent No.: US 10,850,295 B2
(45) Date of Patent: Dec. 1, 2020

(54) SPRINKLER WITH FLOW GUARD FEATURE

(71) Applicant: Hunter Industries, Inc., San Marcos, CA (US)

(72) Inventors: Blake A. Wildt, Carlsbad, CA (US); LaMonte D. Porter, San Marcos, CA (US)

(73) Assignee: Hunter Industries, Inc., San Marcos, CA (US)

( * ) Notice: Subject to any disclaimer, the term of this patent is extended or adjusted under 35 U.S.C. 154(b) by 0 days.

(21) Appl. No.: 15/677,533

(22) Filed: Aug. 15, 2017

(65) Prior Publication Data

US 2019/0054488 A1 Feb. 21, 2019

(51) Int. Cl.

| | |
|---|---|
| ***B05B 15/16*** | (2018.01) |
| ***A62C 35/68*** | (2006.01) |
| ***B05B 1/30*** | (2006.01) |
| ***B05B 15/14*** | (2018.01) |
| *B05B 15/70* | (2018.01) |
| *B05B 1/26* | (2006.01) |

(52) U.S. Cl.

CPC ..... *B05B 15/16* (2018.02); *A62C 35/68* (2013.01); *B05B 1/30* (2013.01); *B05B 1/3006* (2013.01); *B05B 15/14* (2018.02); *B05B 1/267* (2013.01); *B05B 15/70* (2018.02)

(58) Field of Classification Search

CPC ..... B05B 15/16; B05B 15/70; B05B 1/30; A62C 35/68

USPC ..... 239/288

See application file for complete search history.

(56) References Cited

U.S. PATENT DOCUMENTS

| | | | | | |
|---|---|---|---|---|---|
| 1,762,503 | A * | 6/1930 | Buckner | F16L 37/16 | 239/201 |
| 2,926,690 | A * | 3/1960 | Martin | F16K 17/20 | 137/460 |
| 3,971,403 | A * | 7/1976 | Sergent | F16K 21/18 | 137/459 |
| 4,033,374 | A * | 7/1977 | Danon | F16K 17/32 | 137/461 |
| 4,064,889 | A * | 12/1977 | Gayle | F16K 17/366 | 137/539 |
| 4,562,962 | A * | 1/1986 | Hartman | B05B 1/3006 | 239/200 |
| 4,848,661 | A * | 7/1989 | Palmer | B05B 1/304 | 239/204 |
| 4,852,602 | A * | 8/1989 | McKinnon | F16K 15/021 | 137/68.14 |
| 6,179,221 | B1 | 1/2001 | Goldberg et al. | | |

(Continued)

*Primary Examiner* — Chee-Chong Lee

(74) *Attorney, Agent, or Firm* — Knobbe Martens Olson & Bear, LLP

(57) ABSTRACT

An irrigation sprinkler can be provided with a flow guard feature configured to send an indicator stream into the air when a nozzle is missing, while still conserving most of the water that would have been wasted without the flow guard feature. The flow guard feature can include a valve assembly having a first port and a second off-axis port. The second port can be smaller than the first port. The second port can be non-parallel to the first port. The first port can be open when the nozzle is present and be sealed when the nozzle is missing. The second, off-axis port can be open even when the nozzle is missing to provide the indicator stream.

21 Claims, 8 Drawing Sheets

(56) References Cited

U.S. PATENT DOCUMENTS

| | | | | |
|---|---|---|---|---|
| 6,260,575 | B1 * | 7/2001 | Brown | B05B 15/70 137/519.5 |
| 8,833,672 | B2 | 9/2014 | Skripkar et al. | |

* cited by examiner

SPRINKLER WITH FLOW GUARD FEATURE

BACKGROUND

Technical Field

The present disclosure relates to sprinklers used to irrigate lawns, gardens and landscaping, and more particularly, to sprinklers with a flow guard feature for indicating a missing nozzle.

Description of the Related Art

Sprinklers are commonly used for irrigating lawns, gardens, landscaping, and the like. One type of sprinkler has a fixed stem. One end of the fixed stem is typically underground and has an inlet connected to a water supply. Another end of the fixed stem extends above the ground and is fixed with a nozzle, such as a spray nozzle. The nozzle can facilitate diversion of water into a spray. Another popular type of sprinkler is a pop-up rotor-type sprinkler. The pop-up type of sprinkler is usually buried in the ground during non-use, and has a riser that projects above the ground during use. The nozzle can be attached to the riser.

SUMMARY

The present disclosure provides a sprinkler with a flow guard feature to alert a user that the nozzle is missing. Sprinkler nozzles are susceptible and/or prone to damage from tampering, impact on the sprinkler, wear on the sprinkler, and other causes. For example, the nozzle can be stolen, vandalized, and/or damaged. When the nozzle is missing, the water flow cannot be properly diverted into a spray. Instead, water leaving the sprinkler may simply run out to the area immediately surrounding the sprinkler. As a result, a sprinkler with a damaged nozzle cannot effectively irrigate the surrounding area, cause water loss and waste, and may lead to flooding of the surrounding area, among other negative consequences.

To minimize water loss and waste, various types of irrigation sprinklers can have a valve assembly downstream of an inlet receiving the water. An opening of the valve assembly is held open by a spacing fixture locked into place by the nozzle. If the nozzle is missing, pressure of the water from the inlet can seal the opening, which is no longer kept open by the spacing fixture as the spacing fixture would be unconstrained without the nozzle or may also be missing. Although sealing the opening in the valve assembly can conserve water that would be wasted without the valve assembly, it is not immediately apparent to a user that the nozzle is missing when the sprinkler is not spraying water. Therefore, it is harder and/or may take longer for a user to realize that a particular sprinkler is missing the nozzle. The surrounding area may not be effectively irrigated before the nozzle is replaced on that sprinkler. In some cases, the area surrounding the damaged sprinkler can be dry and the vegetation intended to be irrigated may die. In some cases, the area immediately surrounding the damaged sprinkler can be inundated with water.

The present disclosure provides a sprinkler with a valve assembly that includes a first port and a second, smaller, and/or off-axis port. The second port is always open to allow water to flow therethrough when water is supplied at a pressure to an inlet of the sprinkler. During normal operation, the water flow is diverted to the nozzle through both the first and second ports and leaves the nozzle in a spray pattern. However, if the nozzle is missing, water can only flow through the second port, sending a small stream into the air to indicate that the nozzle is missing, while still conserving most of the water that would have been wasted without the valve assembly.

According to some embodiments, an irrigation sprinkler can comprise an elongate body having a passage therethrough, the elongate body comprising an inlet end and an outlet end, respectively; a nozzle releasably mounted at or near the outlet end, the nozzle comprising at least one channel fluidly coupled to the passage of the elongate body; and a valve assembly located upstream of the outlet end of the elongate body and downstream of the inlet end, the valve assembly disposed within the elongate body, the valve assembly comprising a valve body and a valve, the valve body comprising a first port and a second port, the first and second ports each fluidly coupled to the passage of the elongate body, the valve being operatively coupled to the nozzle and configured to move at least partially within the first port and along a longitudinal axis of the first port, at least a portion of the second port being off-axis of the first port, wherein the valve assembly can comprise a closed configuration when the valve seals the first port and an open configuration when the valve does not seal the first port, the second port being open in both the closed configuration and the open configuration. The second port can have a smaller cross-sectional area than the first port. The sprinkler can further comprise a screen coupling the nozzle to the valve, the screen configured to keep the valve assembly in the open configuration by restricting movement of the valve preventing the valve from sealing against the valve body. The valve can comprise a valve stem connected to a valve disc, the valve disc having a diameter greater than an internal diameter of the first port, the valve disc being disposed outside valve body and configured to block a fluid flow through the first port when the valve disc is pressed against the valve body. In some embodiments, a valve disc may have a diameter, equal to, or slightly less than an internal diameter of the first port. The valve stem can be pushed against a screen configured to keep the valve assembly in the open configuration by restricting movement of the valve preventing the valve disc from contacting the valve body. The valve stem can comprise a plurality of retaining tabs configured to couple with a valve stem bearing of the valve body to prevent the valve stem from slipping out of the valve body. The valve disc can be upstream of the first port. A pressurized fluid can be configured to move the valve assembly into the closed configuration if the nozzle is missing from the irrigation sprinkler. At least a portion of the second port can be non-parallel to the longitudinal axis of the first port. At least a portion of the second port can be non-parallel to a longitudinal axis of the elongate body. The valve body can further comprise a channel extending from a valve-contacting surface of the valve body to at least the second port. The channel can be located outside of a perimeter of the valve or the valve disc. The second port can be separately formed from the first port. The valve may not contact the second port. The second port can be dimensioned to provide sufficient flow for a single stream of fluid to exit the outlet end of the elongate body when the valve assembly is in the closed configuration. The sprinkler can further comprise a smaller second conduit configured to be disposed within the elongate body, the second conduit having an inlet that is fluidly coupled to the inlet end of the elongate body. The nozzle can be rotatably mounted on the second conduit, the second conduit is configured to telescope from the elongate body, the nozzle and the valve assembly configured to move with the second conduit.

According to some embodiments, an irrigation sprinkler can comprise an elongate body having a passage therethrough, the elongate body comprising an inlet end and an outlet end, the inlet end configured to receive an inflow of fluid at a first pressure; a nozzle releasably mounted at or near the outlet end, the nozzle comprising at least one channel fluidly coupled to the passage of the elongate body and configured to allow an outflow of water; and a valve assembly located upstream of the outlet end of the elongate body and downstream of the inlet end, the valve assembly comprising a valve body and a valve, the valve body comprising a first port and a second, smaller port, the first port extending from an upstream end of the valve body to the downstream end of the valve body, the second port located on a wall of the valve body between the upstream and downstream ends of the valve body, and the second port having a second port axis different from a longitudinal axis of the first port, each of the first and second ports fluidly coupled to the passage of the elongate body, the valve being operatively coupled to the nozzle and configured to move at least partially within the first port and along the longitudinal axis of the first port, wherein the valve assembly can comprise a closed configuration when the valve seals the first port and an open configuration when the valve does not seal the first port, the second port being open in both the closed configuration and the open configuration. At least a portion of the second port axis can form an acute angle with the longitudinal axis of the first port. At least a portion of the second port axis can form an acute angle with a longitudinal axis of the elongate body.

BRIEF DESCRIPTION OF THE DRAWINGS

Various embodiments are depicted in the accompanying drawings for illustrative purposes, and should in no way be interpreted as limiting the scope of the embodiments. In addition, various features of different disclosed embodiments can be combined to form additional embodiments, which are part of this disclosure. In the drawings, similar elements have reference numerals with the same last two digits.

Figure 1:
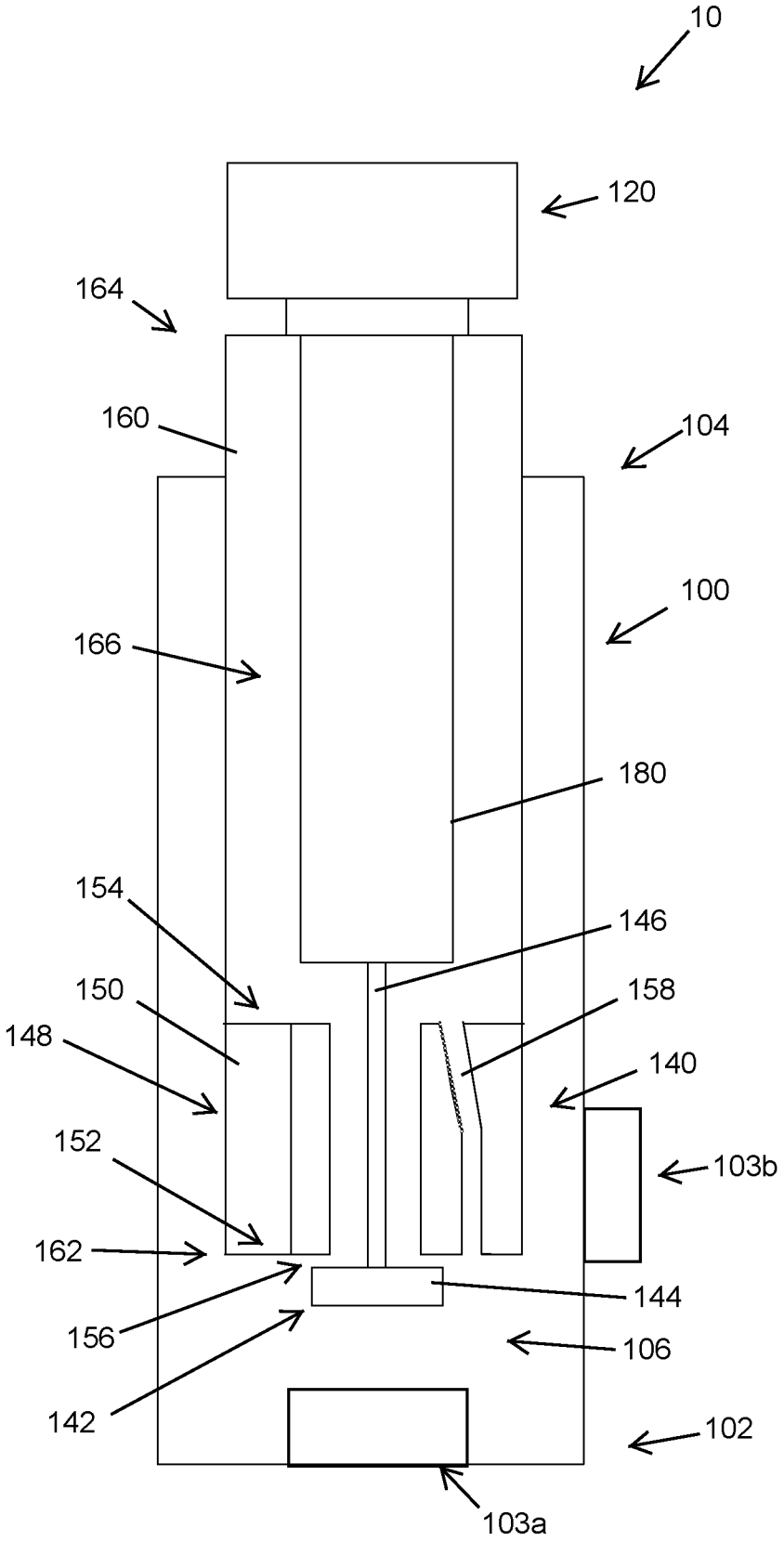
FIG. 1 is a schematic illustration of an irrigation sprinkler with a flow guard feature.

The drawing showing certain embodiments can be semi-diagrammatic and not to scale and, particularly, some of the dimensions are for the clarity of presentation and are shown greatly exaggerated in the drawings.

DETAILED DESCRIPTION

Although certain embodiments and examples are described below, those of skill in the art will appreciate that the disclosure extends beyond the specifically disclosed embodiments and/or uses and obvious modifications and equivalents thereof. Thus, it is intended that the scope of the disclosure herein disclosed should not be limited by any particular embodiments described below.

Referring to FIG. 1, an irrigation sprinkler 10 with a flow guard feature can have an outer housing 100, a nozzle 120, and a valve assembly 140. The sprinkler 10 can optionally include a riser 160. The outer housing 100 can have an elongate body with a first end 102 (e.g., in some cases, the inlet end) and a second end 104 (e.g., in some cases, the outlet end). The riser 160 can be a smaller elongate body with an inlet end 162 and an outlet end 164 disposed within the outer housing 100. The riser 160 can be disposed substantially concentric with the outer housing 100. The irrigation sprinkler 10 can be of a fixed-stem type (e.g., wherein the riser 160 is permanently extended from the outer housing 100), or a pop-up type with the riser 160 (e.g., wherein the riser 160 transitions between an extended position and a retracted position with respect to the outer housing 100). Although some embodiments of the sprinkler are illustrated as a pop-up type in the present disclosure, a person of ordinary skill in the art will appreciate from the disclosure herein that the flow guard feature can be implemented in other types of sprinklers, such as a fixed-stem type.

As shown in FIG. 1, a longitudinal axis of the outer housing 100 can be defined between the first and second ends 102, 104. The outer housing 100 can further have an inlet for receiving an inflow of water and an outlet for the water to exit the outer housing 100. The inlet 103*a* can be located at the first end 102. The second end 104 can be downstream of the first end 102 and can have an opening which can function as the outlet. Alternatively or in addition, an inlet 103*b* may be located on a side wall of the outer housing 100 upstream of the second end 104. The inlets 103*a*, 103*b* can be connected to a water source configured to provide water at a predetermined pressure. The predetermined pressure can be in the range of 15 psi to 100 psi. The outer housing 100 can have a fluid passage 106 extending between the first and second ends 102, 104 along the longitudinal axis.

Figure 2B:
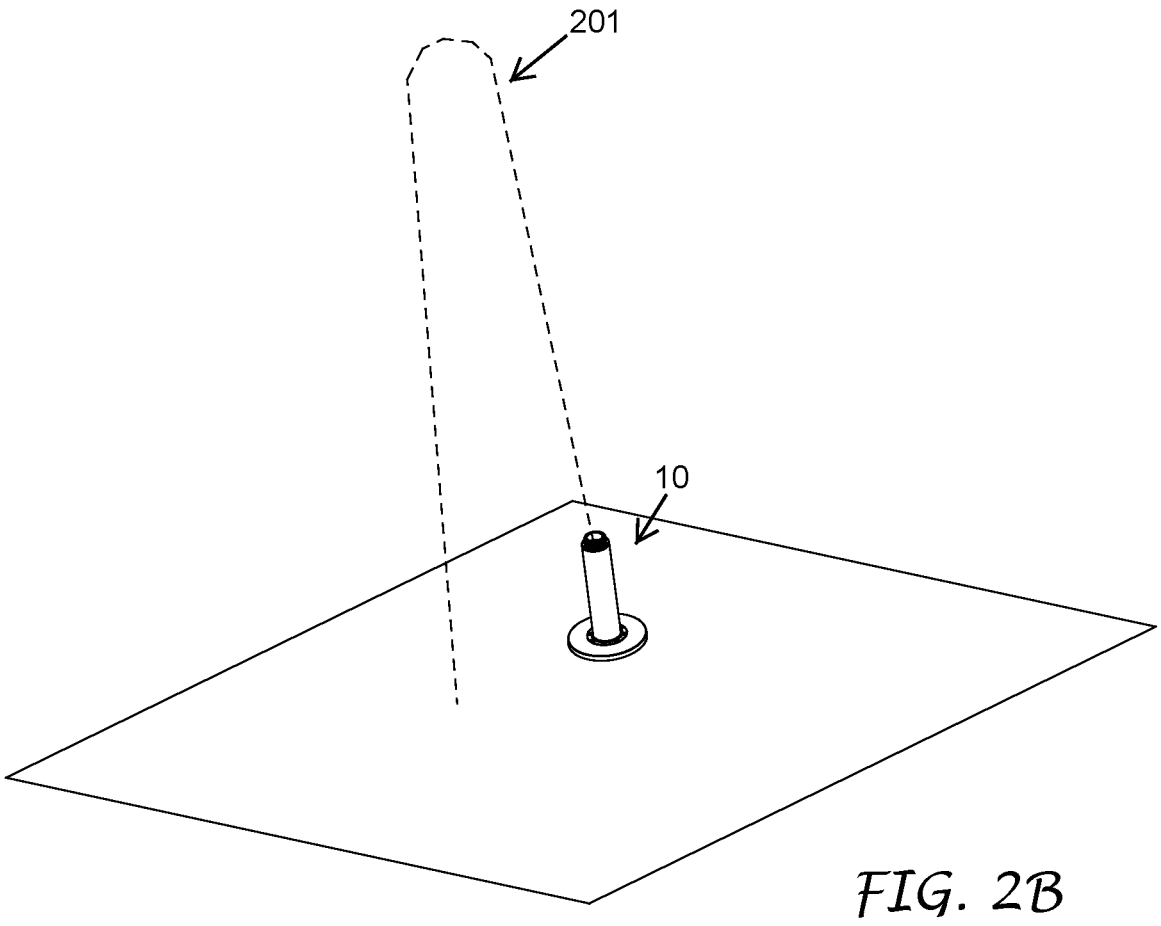
FIGS. 2A and 2B illustrate schematically water outflow patterns of an example sprinkler with a flow guard feature during normal operation and when missing a nozzle, respectively.
Figure 2A:
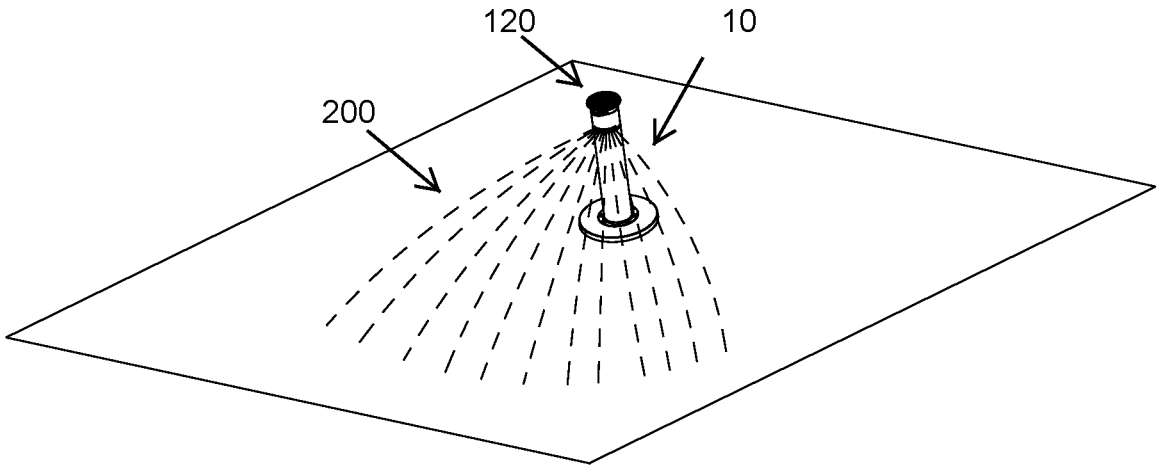

With continued reference to FIG. 1, the nozzle 120 can be mounted at or near the second end 104 of the outer housing 100. The nozzle 120 can be releasably mounted, for example, with mating threads, a retaining spring clip, adhesives, welding, or other mounting methods or structures. In the illustrated embodiment, the nozzle 120 can be mounted onto an outlet end 164 of the riser 160. In some embodiments, the nozzle 120 can be mounted onto the second end 104 of the outer housing 100. The nozzle 120 can have one or more water flow channels. The one or more channels can be in fluid connection with the fluid passage 106 of the outer housing 100. The plurality of water flow channels can be in fluid connection with a fluid passage 166 of the riser 160. The one or more channels can be configured to divert the water from the second end 104 of the outer housing 100 and/or the outlet end 164 of the riser 160 into a spray pattern 200, such as shown in FIG. 2A. When mounted, the nozzle 120 can lock a spacer fixture, such as a filter screen 180, between the nozzle 160 and a valve 142 of the valve assembly 140, which will be described in greater details below. A person of ordinary skill in the art will appreciate from the disclosure herein that other types of spacer fixture, such as a rod, a block, a cage, one or more arms, or the like, can be locked between the nozzle 120 and the valve 142. In some embodiments, the filter screen 180 can be attached to the nozzle 120. In other embodiments, the filter screen 180 can be held in place by (e.g., in a directional parallel to the longitudinal axis of the riser 160) but not attached to the nozzle 120.

Turning to the valve assembly 140, as shown in FIG. 1, the valve assembly 140 can be mounted downstream of the inlets 103*a*, 103*b*, and upstream of the nozzle 120. As shown in FIG. 1, the valve assembly 140 can be disposed within the fluid passage 166 of the riser 160. At least a portion of the valve assembly 140 can be downstream of an inlet end 162 of the riser 160, or at or substantially at the inlet end 162 of the riser 160. In some embodiments, the valve assembly 140 can be disposed directly within the fluid passage 106 of the outer housing 100. The valve assembly 140 can include a valve 142 and a valve body 148. The valve body 148 can have an upstream end 152, a downstream end 154, and an elongate body portion 150 between the upstream and downstream ends 152, 154. The elongate body portion 150 of the valve body 148 can have a longitudinal axis substantially parallel to the longitudinal axis of the outer housing 100. In some embodiments, the longitudinal axis of the valve body 148 can substantially coincide with (e.g., be collinear with) the longitudinal axis of the outer housing 100.

With continued reference to FIG. 1, the valve body 148 can have a first port 156 and a second port 158. The first port 156 can have an inlet on the upstream end 152 of the valve body 148 and an outlet on the downstream end 154 of the valve body 148. In some embodiments, the first port 156 can extend substantially along the longitudinal axis of the valve body 148. In some embodiments, the first port 156 can extend substantially along the longitudinal axis of the riser 160, and/or the longitudinal axis of the outer housing 100. As shown in FIG. 1, the outlet of the first port 156 is in fluid connection with the fluid passage 166 of the riser 160. In some embodiments, the outlet of the first port 156 is in fluid connection with the fluid passage 106 of the outer housing 100. The second port 158 can have an inlet different from the inlet of the first port 156. The second port 158 can have an outlet different from the outlet of the first port 156. The second port 158 can have an inlet and outlet that are both different from the inlet and outlet of the first port 156, respectively. At least a portion of the second port 158 can be offset from the longitudinal axes of one or more of the first port 156, the valve body 148, the longitudinal axis of the riser 160, or the longitudinal axis of the outer housing 100. In some embodiments, the second port 158 can be formed separate and distinct from the first port 156. In other embodiments, a portion of the second port 158 and a portion of the first port 156 downstream of the inlets of the first and second ports 156, 158 can overlap. At least a portion of the second port 158 may not be parallel to the longitudinal axis of the first port 156, and/or the longitudinal axis of the valve body 148, and/or the longitudinal axis of the riser 160, and/or the longitudinal axis of the outer housing 100. For example, a portion of the second port 158 adjacent an outlet of the second port 158 can extend toward the longitudinal axes of the riser 160 and/or outer housing 100.

A valve can open or seal the first port 156 of the valve body 148 in response to a position change of the valve relative to the valve body 148 and/or the first port 156. For example, the valve can have a component that has a cross-sectional width or diameter greater than an internal cross-sectional width or diameter of the first port 156 for sealing the first port 156. Examples of the valve can include a diaphragm, a disc, a mushroom valve, and the like. As will be described in greater details below, the valve can be held in an open configuration when the nozzle 120 is present, and can be moved to a closed configuration to seal the first port 156 when the nozzle 120 is missing.

Turning to the valve 142 as shown in FIG. 1, the valve 142 can include a valve disc 144 connected to a valve stem 146. The valve disc 144 can be upstream of the valve stem 146 when in use. The valve disc 144 can have a cross-sectional width or diameter greater than a cross-sectional width or diameter of the valve stem 146. At least a portion of the valve stem 146 can extend through the first port 156. The cross-sectional internal diameter of the first port 156 can be greater than the cross-sectional diameter of the valve stem 146, but smaller than the cross-section diameter of the valve disc 144. In some embodiments, the valve disc 144 can have a cross-sectional width or diameter equal to, or slightly less than the cross-sectional internal diameter of the first port 156. The cross-sectional internal diameter of the first port 156 can be greater than the cross-sectional internal diameter of the second port 158. The valve stem 146 can freely move along the first port 156. When the valve stem 146 moves upstream (e.g., toward the first end 102), the valve disc 144 can move away from the inlet of the first port 156. The first port 156 is then in an open configuration. When the valve stem 146 moves downstream toward the second end 104 of the outer housing 100 and/or the outlet end 164 of the riser 160, the valve disc 144 can eventually contact the valve body 148, thereby sealing the inlet of the first port 156. As further shown in FIG. 1, the inlet of the second port 158 can be outside a perimeter of the valve disc 144. Preferably, the valve 142 does not contact the second port 158.

As shown in FIG. 1, when the nozzle 120 locks the filter screen 180 in place, the filter screen 180 can inhibit the valve stem 144 from moving too far in a downstream direction to keep the valve disc 144 away from the valve body 148 to keep the first port 156 in the open configuration. In the open configuration, water is diverted through the nozzle 120 into a spray pattern 200 as exemplified in FIG. 2A. Because the first port 156 is bigger than the second port 158, most of the water flows through the first port 156 in the open configuration. When the filter screen 180 is no longer locked into place by the nozzle 120, or when the filter screen 180 is missing, the valve stem 146 can travel in the downstream direction toward the valve body 148 under pressure from the water from the inlet 103*a* or 103*b*, thereby sealing the inlet of the first port 156 in a closed configuration. In the closed configuration, because the first port 156 is sealed, substantially all the water from the inlet 103*a* or 103*b* flows through the smaller off-axis second port 158. Because of the pressure, the water leaving the second port 158 can be a small and/or high velocity stream 201 rising into the air, as exemplified in FIG. 2B. The small stream 201 into the air can provide a readily detectable indication that the nozzle 120, and/or filter screen 180 are missing, while still conserving most of the water that would have been wasted without the valve assembly 140. The addition of the off-axis second port 158 onto the valve body 148 does not interfere with the design and operation of the valve assembly 140 for purposes of sealing the first port 156 when the nozzle 120 is missing. In addition, the small stream 201 is more readily detectable than a lack of water flowing out of a sprinkler so that the nozzle 120, and the filter screen 180, can be replaced more expediently. Having the second port 158 off-axis from the first port 156 can also reduce the likelihood that dirt or debris clogs both ports at the same time. Having the second port 158 off-axis of the first port 156 (e.g., off-axis of the longitudinal axis of the riser 160 and/or outer housing 100) can allow the stream of water to exit the sprinkler 10 at a slight angle to provide an arc-shaped indicator stream 201. In contrast, when an indicator stream is coaxial with the first port, the indicator stream shoots straight up and comes back down upon the sprinkler. The indicator stream 201 exiting the sprinkler 10 at an angle can thus result in a taller stream than when the second port is coaxial with the first port, or require less water to provide the indicator stream 201 with a height sufficient for indicating a missing nozzle.

Figure 3:
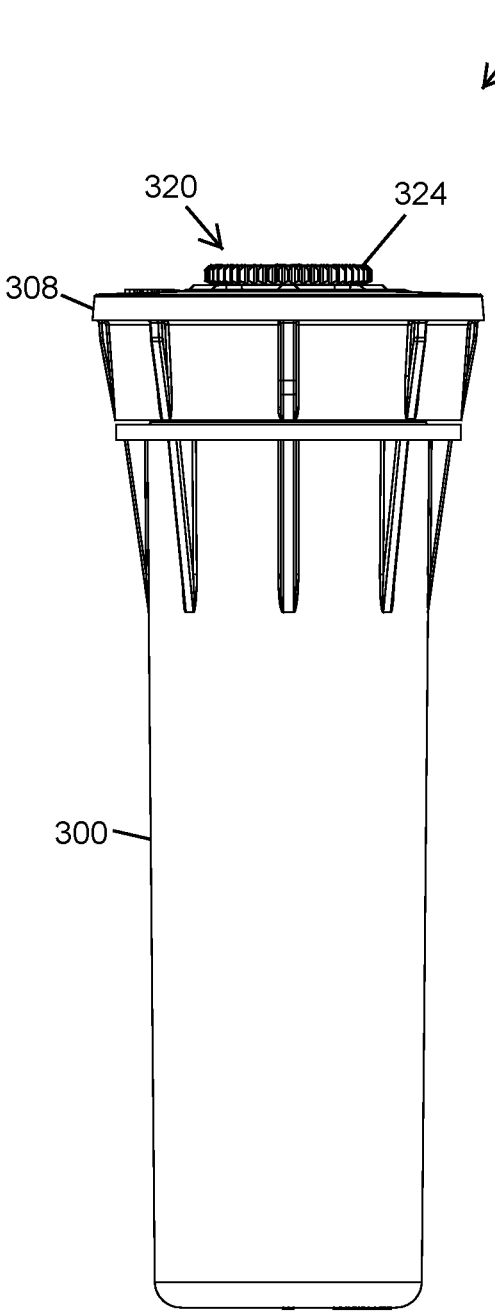
FIG. 3 is a side view of an example irrigation sprinkler with a flow guard feature.

Turning to FIGS. 3-6, an irrigation sprinkler 30 of the present disclosure can have the same features of the sprinkler 10 except as described below. Features of the sprinkler 30 can function in the same or substantially the same manner as features of the sprinkler 10. Accordingly, features of the sprinkler 30 can be incorporated into features of the sprinkler 10 and features of the sprinkler 10 can be incorporated into features of the sprinkler 30. The sprinkler 30 can have a nozzle 320, an outer housing 300, and a valve assembly 340 having a valve body 348 and a valve 342. The outer housing 300 can have an elongate body with an inner passage 306, a first end 302 and outlet second end 304. The outer housing can have an inlet 303 for receiving an inflow of water and an outlet for the water to exit the outer housing 300. The inlet 303 can be at the first end 302, as illustrated in FIG. 3. The second end 304 can be located downstream of the first end 302 and can have an opening that can function as the outlet. In some embodiments, the inlet can be positioned along a sidewall of the outer housing 300 upstream of the second end 304. In some embodiments, the outer housing 300 can have inlets at both the first end 302 and along the sidewall of the outer housing 300. The sprinkler 30 can include a body cap 308. The body cap 308 can be configured to be mounted at or near the second end 304 of the outer housing 300. As shown in the cross-sectional view of FIG. 4, the body cap 308 can have internal threads engaging external threads at or near the second end 304 of the outer housing 300. When mounted, the body cap 308 can lock a cover ring 309 between the body cap 308 and a stem of the nozzle 320. The cover ring 309 can have a lumen just big enough to accommodate a portion 322 of the nozzle 320 having a lesser outer diameter (and optionally a riser 360). A portion 324 of the nozzle 320 having a greater outer diameter can in turn cover at least partially the cover ring 309. The cover ring 309 can thus minimize entry of dirt and/or other debris into a fluid passage 306 of the outer housing 300. In some embodiments, the cover ring 309 may be formed as part of a seal 310.

Figure 4:
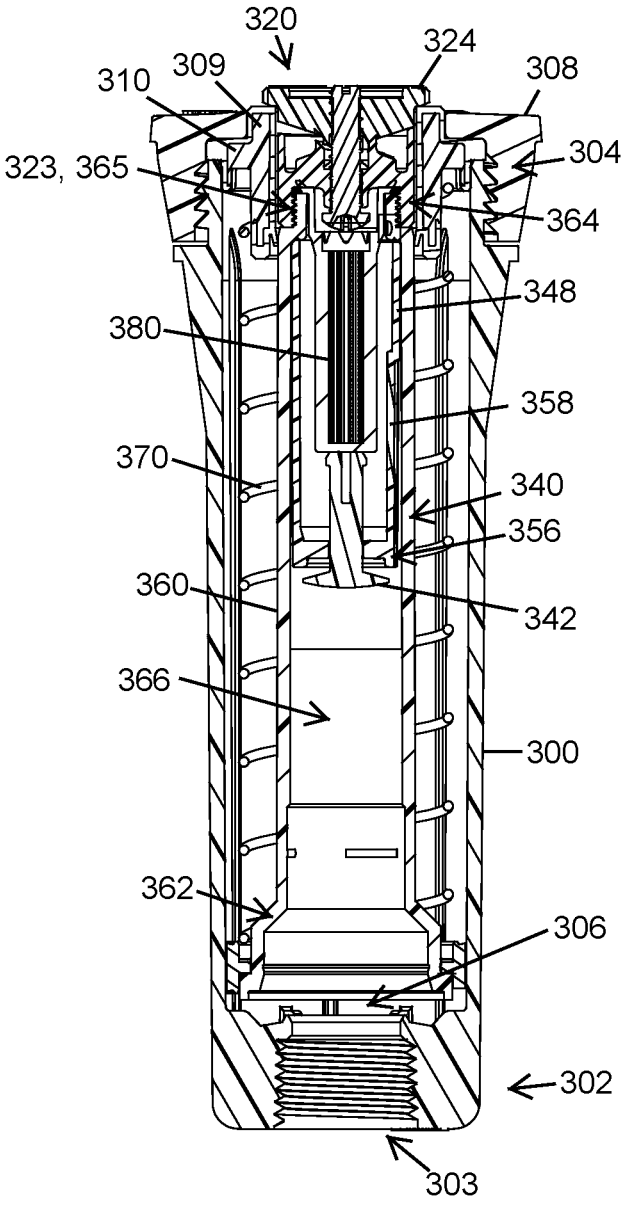
FIG. 4 is a cross-sectional view of the irrigation sprinkler of FIG. 3.
Figure 5:
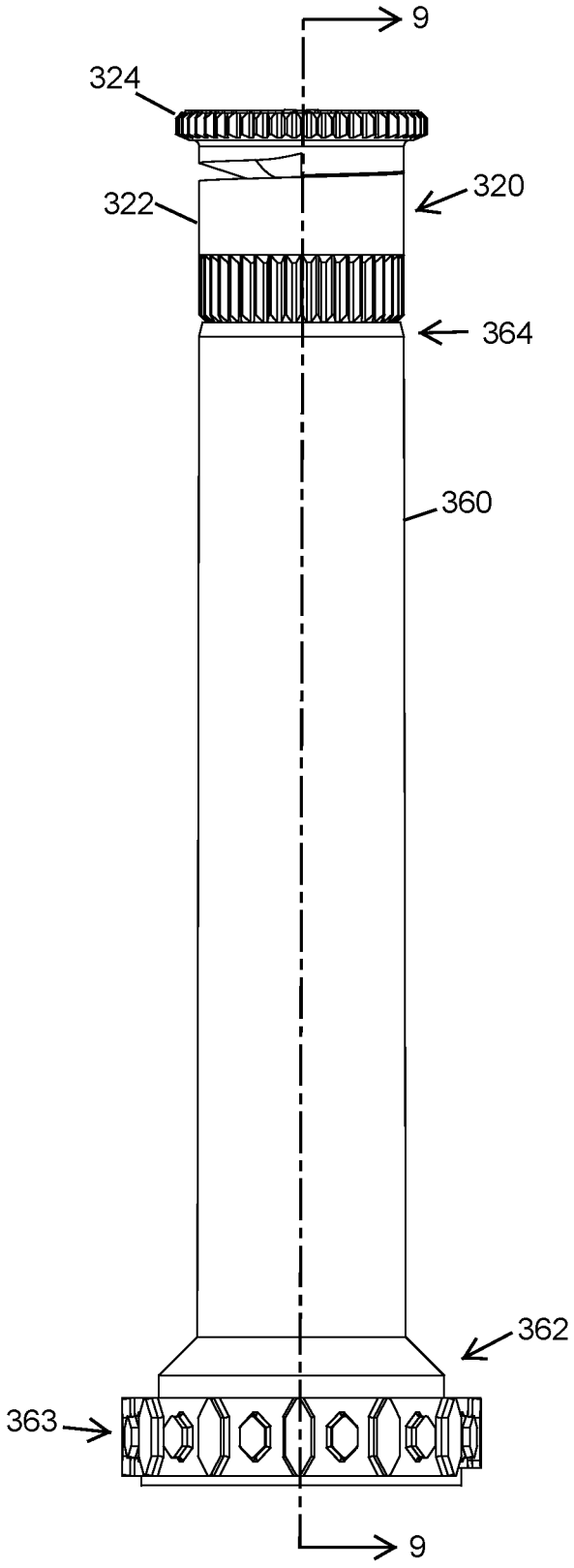
FIG. 5 is a side view of an example irrigation sprinkler with an outer housing/elongate body removed for clarity.
Figure 6:
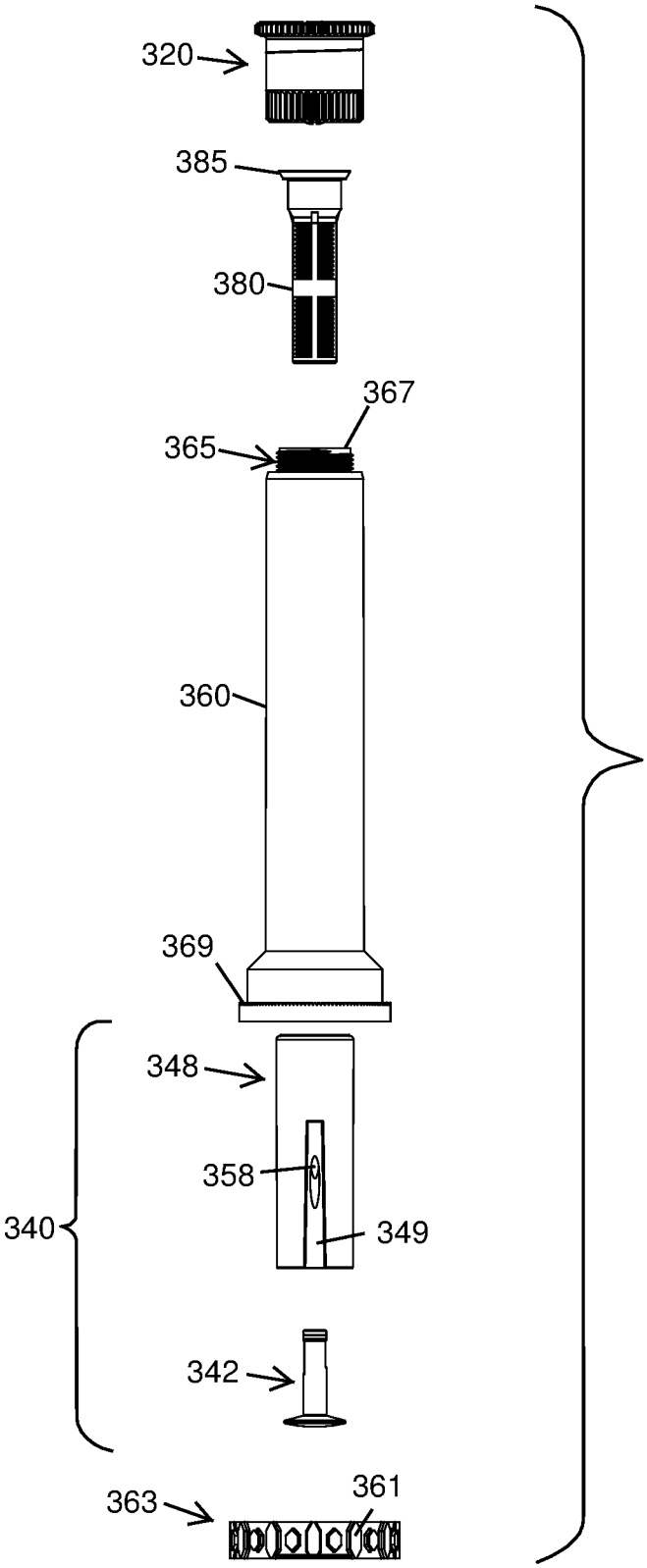
FIG. 6 is an exploded view of the irrigation sprinkler of FIG. 5.

As shown in FIGS. 4-6, the sprinkler 30 can have the riser 360. The riser 360 can be a smaller elongate body with an inner passage 366, an inlet end 362 and an outlet end 364. The riser 360 can be disposed at least partially within the outer housing 300. The riser 360 can be disposed within the fluid passage 306 of the outer housing 300. The riser 360 can be substantially concentric with the outer housing 300. An inlet end 362 of the riser 360 can be downstream of an inlet 303, which can be at the first end 302 of the outer housing 300, or positioned along the side wall of the outer housing 300, or both, as described above. An outlet end 364 of the riser 360 can be releasably coupled to the nozzle 320. As shown in FIG. 4, the outlet end 364 of the riser 360 can have threads 365 configured to engage threads 323 in the nozzle 320. The riser 360 can be reciprocable within the fluid passage 306 of the outer housing 300 along the longitudinal axis of the outer housing 300. When not in use (e.g., when pressurized water is not provided to the inlet of the outer housing 300), the riser 360 and the nozzle 320 can be in a retracted position. In some embodiments, the portion of greater outer diameter, or the cap 324, of the nozzle 320 can be flush or substantially flush with a flat surface of the body cap 308 when the riser is in the retracted position. In some embodiments, the nozzle cap 324 is at or substantially at a ground surface level when the riser 360 is in the retracted position. A coil spring 370 can be disposed within the fluid passage 306 of the outer housing 300. The coil spring 370 can surround a circumference of the riser 360. The coil spring 370 can span substantially a length of the fluid passage 306. The riser 360 can be biased in the retracted position by the coil spring 370. When in use, pressurized water from the inlet 303 can push the riser 360 into an elevated position. The water pressure can be sufficient to overcome the biasing force of the coil spring 370. The riser 360 and the nozzle 320 can telescope from the outer housing 300 in the elevated position. In some embodiments, the nozzle 320 can extend above the ground surface level at a predetermined height in the elevated position. When the water is turned off, the riser 360 can return to the retracted position due to the biasing force of the coil spring 370.

As shown in FIGS. 5 and 6, the riser 360 can include a ratcheting ring 363. The ratcheting ring 363 can be mounted at or near the inlet end 362 of the riser. The ratcheting ring 363 can be attached to the riser 360, for example, by press fit, or be an integral part of the riser 360. In some embodiments, the ratcheting ring 363 can be loosely attached to the inlet end 362 of the riser 360. The ratcheting ring 363 may include lower or inner protrusions 368 (FIGS. 9 and 10) that interface with mating protrusions 369 formed on the riser 360. In some embodiments, the ratchet ring 363 may turn, or ratchet to a different position, relative to the riser 360 when a user provides a rotational force to the riser 360. The ratcheting ring 363 can have a plurality of external protrusions 361, for example, protruding circles and/or polygons, distributed around a circumference of the ratcheting ring 363. The plurality of external protrusions 361 can be part of a detent mechanism, which can work with an inner wall surface of the outer housing 300 to resist free rotation of the riser 360 relative to the outer housing 300.

Figure 7:
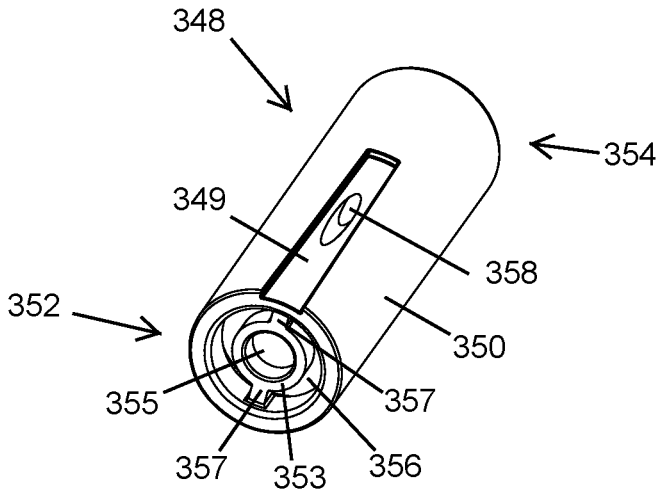
FIG. 7 is a perspective view of an example valve body of a valve assembly.

More details of the valve assembly 340 of the sprinkler 30 will now be described with reference to FIGS. 7 and 8A-8C. The valve assembly 340 can include a valve 342 and a valve body 348. As shown in FIG. 7, the valve body 348 can have an upstream end 352, a downstream end 354, and an elongate body portion 350 between the upstream and downstream ends 352, 354. The elongate body portion 350 can have a longitudinal axis substantially parallel to the longitudinal axis of the outer housing 300 and/or the longitudinal axis of the riser 360. In some embodiments, the longitudinal axis of the valve body 348 can substantially coincide with the longitudinal axis of the outer housing 300 and/or the longitudinal axis of the riser 360. The valve body 348 can further include a valve stem bearing 353 disposed within the elongate body portion 350. The valve stem bearing 353 can have a throughbore 355 having an internal diameter configured to allow a valve stem 346 of the valve 342, which will be described in greater details below, to slide along the valve stem bearing 353. The valve stem bearing 353 can be connected to an inner wall of the valve body 348 with a plurality of connection tabs 357 or ribs. The valve stem bearing 353 and the plurality of connection tabs 357 can be attached to the valve body 348 or be an integral part of the valve body 348. In some embodiments, the valve stem bearing 353 is an aperture formed in a transverse wall at or near the upstream end 352 of the elongate body portion 350. In some such embodiments, the transverse wall includes additional apertures through which water may flow when the valve is in the open position.

Figure 10:
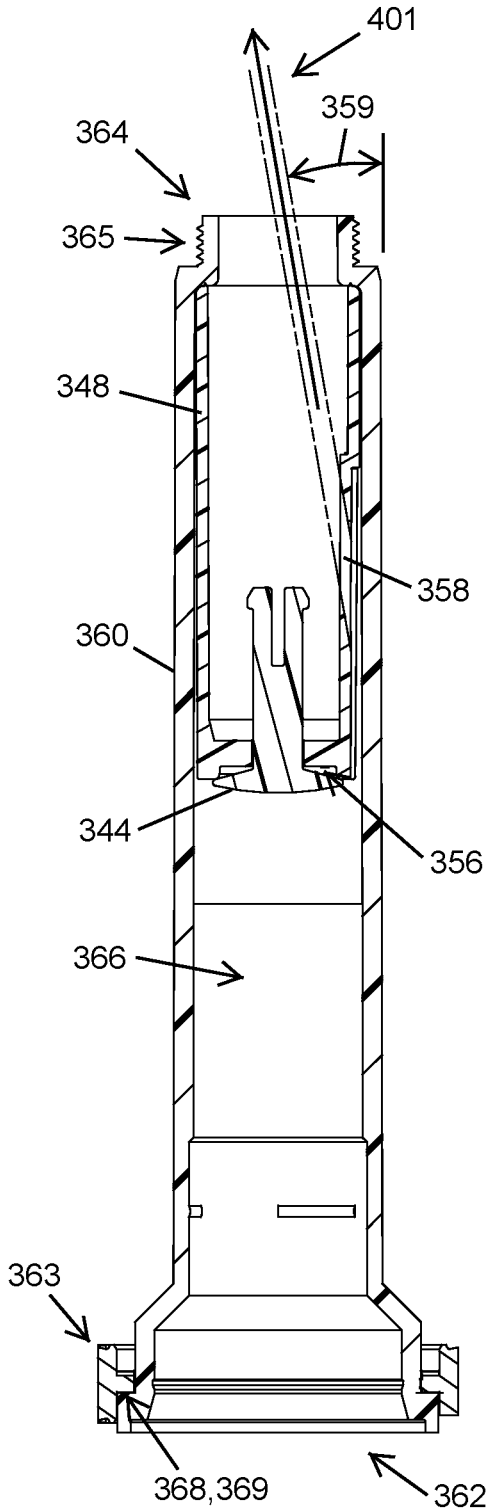

With continued reference to FIGS. 7 and 8A-8C, the valve body 348 can have a first port 356 and a second port 358. The cross-section internal diameter (e.g., the effective cross-sectional area through which water can flow) of the first port 356 can be greater than the cross-sectional internal diameter (e.g., the effective cross-sectional area through which water can flow) of the second port 358. The first port 356 can have an inlet on the upstream end 352 of the valve body 348 and an outlet on the downstream end 354 of the valve body 348. The first port 356 can extend substantially along the longitudinal axis of the valve body 348, and/or the longitudinal axis of the riser 360, and/or the longitudinal axis of the outer housing 300. The second port 358 can have an inlet different from the inlet of the first port 356. The inlet of the second port 358 can be located on an outer side wall of the elongate body portion 350. The outer side wall of the elongate body portion 350 of the valve body 348 can optionally have a channel 349 extending from the upstream end 352 of the valve body 348 to at least the inlet of the second port 358. A portion of the second port 358 in the side wall of the elongate body portion 350 can extend in the downstream direction from the inlet of the second port 358. The portion of the second port 358 can exit an inner side wall of the elongate body portion 350 at an angle, such as an acute angle 359 as shown in FIG. 10, from the longitudinal axis of at least one of the valve body 348, the longitudinal axis of the riser 360, or the longitudinal axis of the outer housing 300. The angle of the exit of the second port 358 with respect to the longitudinal axes can be at least 2°, at least 5°, at least 8°, at least 11°, at least 14°, at least 18°, at least 25°, and/or at least 35°. In some embodiments, the angle is approximately 10°. At least the portion of the second port 358 can be offset from the longitudinal axis of at least one of the first port 356, the longitudinal axis of the valve body 348, the longitudinal axis of the riser 360, and the longitudinal axis of the outer housing 300. Exact location of the portion of the second port 358 across the side wall of the elongate body portion 350 of the valve body 348 is not limiting. A portion of the second port 358 can be near the upstream end 352 of the valve body 348, or near the downstream end 354 of the valve body 348, or anywhere along the elongate body portion 350.

Figure 8A:
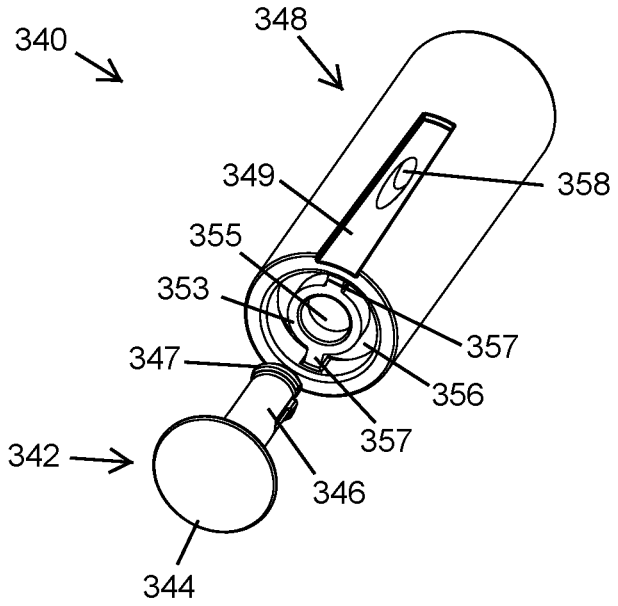
FIG. 8A shows an exploded perspective view of an example valve assembly of an irrigation sprinkler with a flow guard feature.
Figure 8B:
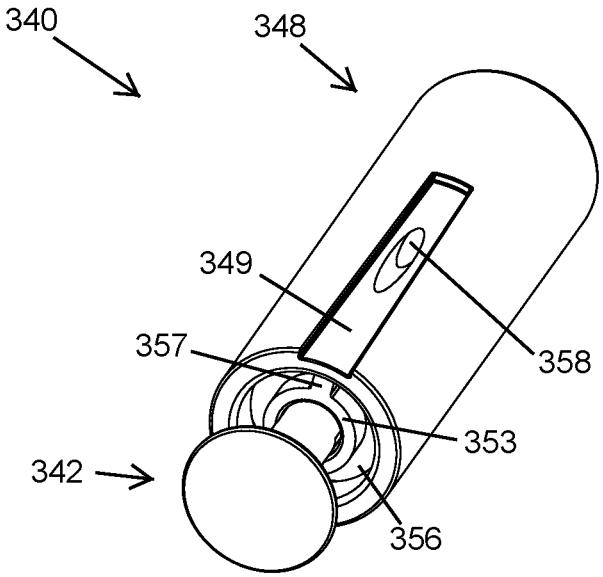
FIG. 8B shows a perspective view of the valve assembly of FIG. 8A in an open configuration.
Figure 8C:
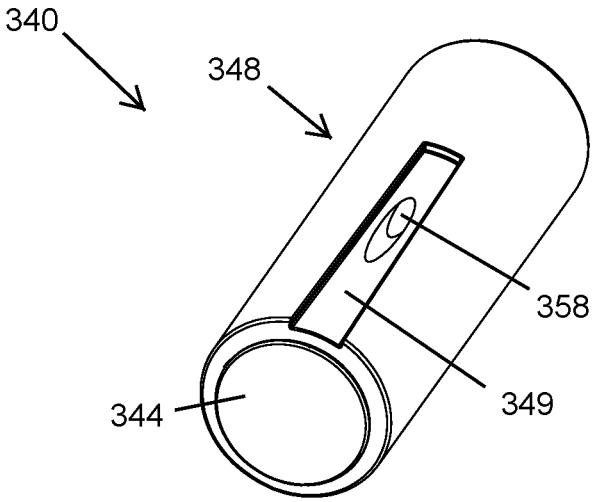
FIG. 8C shows a perspective view of the valve assembly of FIG. 8A in a closed configuration.
Figure 9:
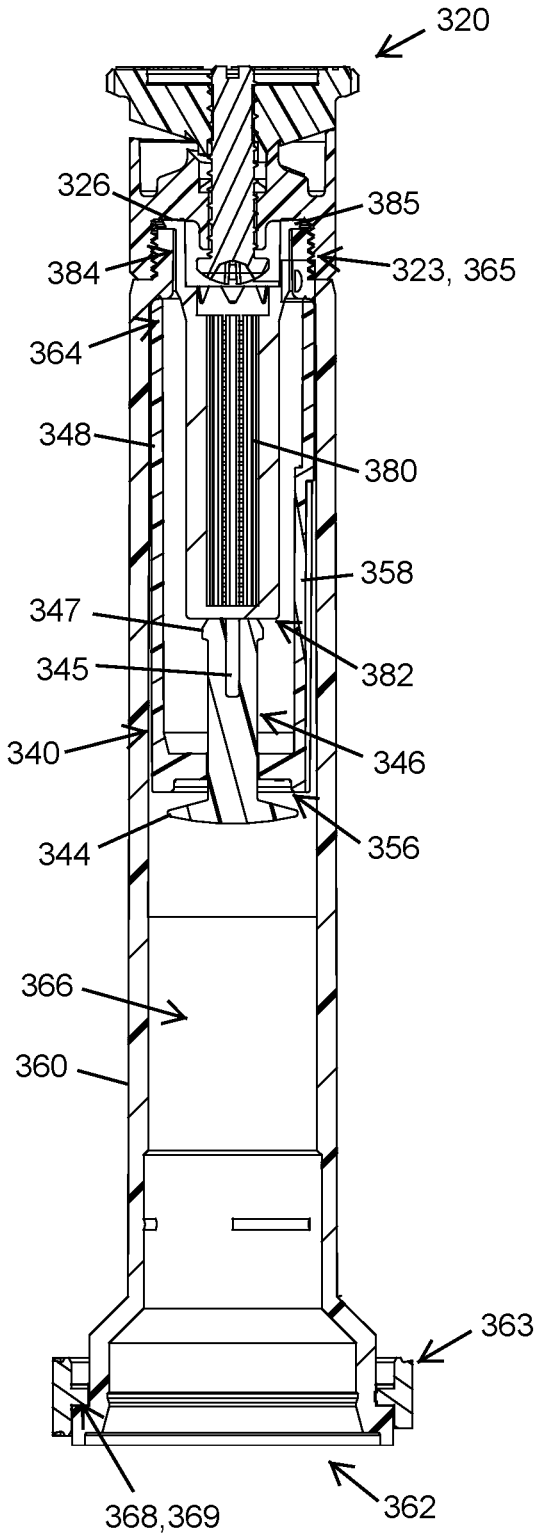
FIGS. 9 and 10 are cross-sectional views of the irrigation sprinkler of FIG. 5 with and without a nozzle, respectively.

Turning to the valve 342, which are shown in FIGS. 8A-8C, the valve 342 can include a valve disc 344 connected to a valve stem 346. When mounted, the valve disc 344 can be upstream of the valve stem 346. The valve disc 344 can have a cross-sectional width or diameter greater than a cross-sectional width or diameter of the valve stem 346. As described above, the valve stem 346 can slide along the throughbore 355 of the valve stem bearing 353. The valve stem 346 can further have at least one retaining tab. The valve stem 346 can have 3, 4, or more retaining tabs. In some embodiments, the valve stem 346 can have at least two retaining tabs 347 (FIG. 9). The at least two retaining tabs 347 can be located at or near a free end of the valve stem 346. The at least two retaining tabs 347 can extend beyond a perimeter of the throughbore 355 of the valve stem bearing 353. The at least two retaining tabs 347 can be separated by a gap 345 (see, e.g., FIG. 9), allowing the at least two retaining tabs 347 to be depressed for insertion into the throughbore 355 of the valve stem bearing 353. After passing the throughbore 355, the at least two retaining tabs 347 can expand to their original positions, which can inhibit or prevent the valve stem 346 from slipping out of the valve stem bearing 353 and/or the valve body 348 in the upstream direction. In the downstream direction, the valve stem 346 can be stopped from further advancement when the valve disc 344 contacts or is pushed against the valve body 348.

Similar to the valve 142 as described with reference to the sprinkler 10, when the valve stem 346 moves upstream (e.g., toward the first end 302), the valve disc 344 can move away from the inlet of the first port 356. The first port 356 is in an open configuration. The second port 358 is also open when the first port 356 is in the open configuration. When the valve stem 346 moves downstream toward the outlet end 364 of the riser 360, the valve disc 344 can eventually contact the valve body 348, thereby sealing the inlet of the first port 356. As further shown in FIG. 8C, the inlet of the second port 358 can be outside a perimeter of the valve disc 344. Even when the valve disc 344 seals the inlet of the first port 356, the valve disc 344 does not contact the second port 358. The second port 358 is configured to remain open when the first port 356 is in the closed configuration.

Turning to FIG. 9, the valve assembly 340 can be mounted near the outlet end 364 of the riser 360. The valve body 348 can be located immediately below the threaded portion 365 of the riser 360. In some embodiments, the valve assembly 340 can be located further upstream, such as closer to the inlet end 362 of the riser 360. The outlet of the first port 356 and the outlet of the second port 358 can be in fluid connection with the fluid passage 366 of the riser 360, and the fluid passage 306 of the outer housing 300. A filter screen 380 can be positioned between the nozzle 320 and the valve stem 346 of the valve 342. The filter screen 380 can have a length configured for keeping the valve disc 344 from contacting the valve body 348 so that the first port 356 is maintained in the open configuration by the nozzle 320 and the filter screen 380. Returning to FIG. 4, a flow path can be established from the inlet 303 along the fluid passage 306 of the outer housing 300 and the fluid passage 366 of the riser, through the first and second ports 356, 358 of the valve assembly 340, to the nozzle 320. Because the first port 356 is bigger than the second port 358, most of the water flows through the first port 356 than through the second port 358.

With continued reference to FIG. 9, the filter screen 380 can have a valve-engaging end 382 and a nozzle-engaging end 384. The valve-engaging end 382 can be a surface configured to abut the free end of the valve stem 346. In some embodiments, the surface can include grooves, or indentations, or ridges, or protrusions for engaging and aligning the valve stem 346. The nozzle-engaging end 384 can include a flange 385 (FIGS. 6 and 9). The nozzle 320 can include an internal seating surface 326. The flange 385 can be configured to rest on the end surface 367 (FIG. 6) of the outlet end 364 of the riser 360. When the nozzle 320 is threaded onto the threads 365 of the riser 360, the screen flange 385 can be captured between the end surface 367 of the riser 360 and the internal seating surface 326 of the nozzle 320. The engagement between the nozzle 320 and the nozzle-engaging end 384 of the filter screen 380 and the outlet end 364 of the riser 360 can inhibit or prevent the filter screen 380 from moving in the downstream direction (e.g. under pressure from the water from the inlet 303 (FIG. 4))

when the nozzle 320 is mounted onto the outlet end 364 of the riser 360. In some embodiments, an engagement between the nozzle 320 and the nozzle-engaging end 384 of the filter screen 380 can allow the filter screen 380 to move with the nozzle 320. The nozzle 320 can be attached or locked to the nozzle-engaging end 384 of the filter screen 380.

Turning to FIG. 10, the nozzle 320 and the filter screen 380 are missing in the sprinkler 30. The nozzle 320 can be unscrewed from the external threads 365 of the riser 360. The nozzle 320 and optionally the filter screen 380 can then be removed from the sprinkler 30. The threads of the nozzle 320 can be damaged so that the nozzle 320 is no longer capable of being held in place by engagements of its internal threads and the external threads 365 of the riser 360. Pressure of water from the inlet 303 (FIG. 4) can push the loose nozzle 320 and the filter screen 380 out of the sprinkler 30. Without the nozzle 320 and the filter screen 380 holding the valve disc 344 away from the valve body 348, the water pressure can then push the valve disc 344 against the valve body 348. The first port 356 can be sealed when water is turned on without the nozzle 320, and optionally without the filter screen 380. The second port 358 remains open even though the first port 356 is closed. A flow path can be established from the inlet 303 along the fluid passage 306 of the outer housing 300 and the fluid passage 366 of the riser 360, through the second port 358 of the valve assembly 340, to the outlet end 364 of the riser 360. Because the second port 358 is smaller than the first port 356, water leaves the second port 358 and the fluid passage 366 of the riser 360 in an indicator stream 401 that shoots into the air. The second port 358 is dimensioned to provide sufficient flow for the indicator stream 401, while still conserving most of the water that would have been wasted in the absence of the valve assembly 340.

While a number of variations of the disclosure have been shown and described in detail, other modifications, which are within the scope of this disclosure, will be readily apparent to those of skill in the art based upon this disclosure. It is also contemplated that various combinations or sub-combinations of the specific features and aspects of the embodiments may be made and still fall within the scope of the disclosure. Accordingly, it should be understood that various features and aspects of the disclosed embodiments can be combined with or substituted for one another in order to form varying modes of the disclosed.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings) may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. An irrigation sprinkler for releasably connecting to a downstream end of a pipe of a subterranean irrigation system, the sprinkler comprising:

an elongate body of the sprinkler having a passage therethrough defining a longitudinal axis, the elongate body comprising an inlet end and an outlet end coaxially disposed along the longitudinal axis, the inlet end configured to releasably connect to the downstream end of the pipe of the subterranean irrigation system;

a nozzle releasably mounted at or near the outlet end of the elongate body of the sprinkler, the nozzle comprising at least one channel fluidly coupled to the passage of the elongate body; and a valve assembly comprising a valve body and a valve, the valve body and the valve being disposed within the elongate body of the sprinkler and between the outlet end and the inlet end, the valve body comprising a first port and a second port, the first and second ports each fluidly coupled to the passage of the elongate body, the second port comprising an inlet, an outlet, and an internal wall, the outlet being recessed into an outer side wall of the valve body, the internal wall defining a direction for a stream of fluid to exit the outlet, the valve being operatively coupled to the nozzle and configured to move at least partially within the first port and parallel to the longitudinal axis, wherein the valve assembly comprises a closed configuration when the valve seals the first port and an open configuration when the valve does not seal the first port, a location of the second port being fixed relative to the elongate body when the valve assembly is in both the closed configuration and the open configuration, the second port being open when the valve assembly is in both the closed configuration and the open configuration, and wherein the internal wall of the second port is off-axis of the first port and configured to direct the stream of fluid to exit the sprinkler at an angle that is different than the longitudinal axis of the elongate body when the valve assembly is in the closed configuration and the nozzle is not mounted to the elongate body of the sprinkler.

2. The irrigation sprinkler of claim 1, wherein the second port has a smaller cross-sectional area than the first port.

3. The irrigation sprinkler of claim 1, further comprising a screen coupling the nozzle to the valve, the screen configured to keep the valve assembly in the open configuration by restricting movement of the valve preventing the valve from sealing against the valve body.

4. The irrigation sprinkler of claim 1, wherein the valve comprises a valve stem connected to a valve disc, the valve disc having a diameter greater than an internal diameter of the first port, the valve disc being disposed outside valve body and configured to block a fluid flow through the first port when the valve disc is pressed against the valve body.

5. The irrigation sprinkler of claim 4, wherein the valve stem is pushed against a screen configured to keep the valve assembly in the open configuration by restricting movement of the valve preventing the valve disc from contacting the valve body.

6. The irrigation sprinkler of claim 5, wherein the valve stem comprises a plurality of retaining tabs configured to couple with a valve stem bearing of the valve body to prevent the valve stem from slipping out of the valve body.

7. The irrigation sprinkler of claim 4, wherein the valve disc is upstream of the first port.

8. The irrigation sprinkler of claim 1, wherein a pressurized fluid is configured to move the valve assembly into the closed configuration if the nozzle is missing from the irrigation sprinkler.

9. The irrigation sprinkler of claim 1, wherein the internal wall of the second port is not parallel to a longitudinal axis of the first port.

10. The irrigation sprinkler of claim 1, wherein the internal wall of the second port is adjacent to an outlet of the second port.

11. The irrigation sprinkler of claim 1, wherein the valve body further comprises a channel extending from a valve-contacting surface of the valve body to at least the inlet of the second port.

12. The irrigation sprinkler of claim 11, wherein the channel is located outside of a perimeter of the valve or the valve disc.

13. The irrigation sprinkler of claim 11, wherein the channel of the valve body is recessed into the outer side wall.

14. The irrigation sprinkler of claim 1, wherein the second port is separately formed from the first port.

15. The irrigation sprinkler of claim 1, wherein the valve does not contact the second port.

16. The irrigation sprinkler of claim 1, wherein the second port is dimensioned to provide sufficient flow for the stream of fluid to exit the outlet end of the elongate body when the valve assembly is in the closed configuration.

17. The irrigation sprinkler of claim 1, further comprising a smaller elongate body configured to be disposed within the elongate body of the sprinkler, the smaller elongate body having an inlet that is fluidly coupled to the inlet end of the elongate body of the sprinkler.

18. The irrigation sprinkle of claim 17, wherein the nozzle is rotatably mounted on the smaller elongate body, the smaller elongate body is configured to telescope from the elongate body of the sprinkler, the nozzle and the valve assembly configured to move with the smaller elongate body.

19. The irrigation sprinkler of claim 1, wherein the internal wall of the second port is further configured to direct the stream of fluid into the air.

20. The irrigation sprinkler of claim 19, wherein the angle is an acute angle, and wherein the directed stream forms an arc-shape.

21. An irrigation sprinkler, the sprinkler comprising:

an elongate body of the sprinkler having a passage therethrough, the elongate body comprising an inlet end and an outlet end, respectively;

a smaller elongate body of the sprinkler configured to be disposed within and telescope upward and then downward relative to the elongate body of the sprinkler, the smaller elongate body having an inlet that is fluidly coupled to the inlet end of the elongate body of the sprinkler;

a nozzle rotatably mounted on the smaller elongate body, the nozzle comprising at least one channel fluidly coupled to the passage of the elongate body of the sprinkler; and a valve assembly located upstream of the outlet end of the elongate body of the sprinkler and downstream of the inlet end of the elongate body of the sprinkler, the valve assembly disposed within the elongate body of the sprinkler, the valve assembly comprising a valve body and a valve, the valve body comprising a first port and a second port, the first and second ports each fluidly coupled to the passage of the elongate body of the sprinkler, the second port comprising an inlet, an outlet, and an internal wall, the outlet being recessed into an outer side wall of the valve body, the internal wall defining a direction for a stream of fluid to exit the outlet, the valve being operatively coupled to the nozzle and configured to move at least partially within the first port and along a longitudinal axis of the first port, at least a portion of the second port being off-axis of the first port, wherein the valve assembly comprises a closed configuration when the valve seals the first port and an open configuration when the valve does not seal the first port, a location of the second port being fixed relative to the smaller elongate body when the valve assembly is in both the closed configuration and the open configuration, the second port being open when the valve assembly is in both the closed configuration and the open configuration, wherein the internal wall of the second port is off-axis of the first port and configured to direct the stream of fluid to exit the sprinkler at an angle that is different than the longitudinal axis of the elongate body when the valve assembly is in the closed configuration and the nozzle is not mounted to the elongate body of the sprinkler, and wherein the nozzle and the valve assembly are configured to move with the smaller elongate body at least when the smaller elongate body telescopes downward relative to the elongate body of the sprinkler.

* * * * *